US008262207B2

(12) United States Patent
Ikushima

(10) Patent No.: US 8,262,207 B2
(45) Date of Patent: Sep. 11, 2012

(54) INK-JET HEAD AND INK-JET DEVICE

(75) Inventor: Kazumasa Ikushima, Tokyo (JP)

(73) Assignee: Musashi Engineering, Inc., Mitaka-shi, Tokyo (JP)

( * ) Notice: Subject to any disclaimer, the term of this patent is extended or adjusted under 35 U.S.C. 154(b) by 336 days.

(21) Appl. No.: 12/595,364

(22) PCT Filed: Apr. 11, 2008

(86) PCT No.: PCT/JP2008/000952

§ 371 (c)(1),
(2), (4) Date: Dec. 17, 2009

(87) PCT Pub. No.: WO2008/126420

PCT Pub. Date: Oct. 23, 2008

(65) Prior Publication Data

US 2010/0103229 A1 Apr. 29, 2010

(30) Foreign Application Priority Data

Apr. 11, 2007 (JP) ..... 2007-103353

(51) Int. Cl.
*B41J 2/175* (2006.01)

(52) U.S. Cl. ..... 347/85; 347/84

(58) Field of Classification Search ..... 347/25, 347/28, 49, 84, 85; 137/240, 625.4, 625.41, 137/625.42

See application file for complete search history.

(56) References Cited

U.S. PATENT DOCUMENTS 3,930,258 A * 12/1975 Dick et al. ..... 347/7
3,960,255 A * 6/1976 Bisson et al. ..... 400/120.16
4,002,230 A * 1/1977 Schweppe et al. ..... 347/21
4,390,883 A 6/1983 Stoneburner
4,623,897 A 11/1986 Brown et al.
5,359,357 A * 10/1994 Takagi et al. ..... 347/49
5,659,347 A * 8/1997 Taylor ..... 347/85
6,588,339 B2 * 7/2003 Naniwa et al. ..... 101/465
2006/0164448 A1 7/2006 Sugiyama et al.
2006/0164470 A1 7/2006 Langford et al.
2008/0273063 A1 11/2008 Wouters et al.

(Continued)

FOREIGN PATENT DOCUMENTS

EP 2127883 A1 12/2009

(Continued)

OTHER PUBLICATIONS

Supplementary European Search Report dated Apr. 22, 2010, issued in corresponding European Patent Application No. EP08738558.

(Continued)

*Primary Examiner* — Anh T. N. Vo
(74) *Attorney, Agent, or Firm* — Westerman, Hattori, Daniels & Adrian, LLP

(57) ABSTRACT

An ink jet ejection head suitable for realizing maintenance of an ink jet head in such a manner as restoring ink ejection performance and ensuring satisfactory application free from an ejection failure in one or more nozzles. The ink jet ejection head of a liquid material application apparatus has an ink jet head, a head holding member for holding the ink jet head in a detachable manner, and a changing-over mechanism connected to a liquid supply passage and a pressurized air supply passage. The changing-over mechanism selectively supplies one of a liquid and pressurized air to the ink jet head. The liquid material application apparatus includes the ink jet ejection head.

23 Claims, 12 Drawing Sheets

U.S. PATENT DOCUMENTS

| | | | |
|---|---|---|---|
| 2008/0297577 | A1 | 12/2008 | Wouters et al. |
| 2009/0040249 | A1 | 2/2009 | Wouters et al. |
| 2009/0295881 | A1 | 12/2009 | Tasaka et al. |

FOREIGN PATENT DOCUMENTS

| | | | |
|---|---|---|---|
| JP | 7-81089 | A | 3/1995 |
| JP | 7-304191 | A | 11/1995 |
| JP | 10-28917 | A | 2/1998 |
| JP | 2001-239196 | A | 9/2001 |
| JP | 2004-321979 | A | 11/2004 |
| JP | 3800855 | B2 | 7/2006 |
| JP | 2008-136970 | A | 6/2008 |
| WO | 2006/064036 | A1 | 6/2006 |

OTHER PUBLICATIONS

International Search Report of PCT/JP2008/000952, mailing date of Jul. 15, 2008.

* cited by examiner

INK-JET HEAD AND INK-JET DEVICE

TECHNICAL FIELD

The present invention relates to an ejection head capable of selectively supplying a liquid and pressurized air to an ink jet head (also referred to as an "ink jet recording head"), and also relates to an apparatus including the ejection head.

BACKGROUND ART

Generally, an ink jet recording apparatus includes a maintenance mechanism for maintaining ink ejection performance. In one known maintenance mechanism, after covering a nozzle surface of an ink jet head with a cap, a negative pressure suction pump is operated to cause a negative pressure suction force to act on the nozzle surface of the ink jet head, thereby recovering waste ink from the ink jet head side.

For example, Patent Document 1 discloses a structure comprising a cap for covering a nozzle surface of an ink jet head, a negative pressure suction pump connected for fluid communication to an ink drain port of the cap through a connecting tube, and a waste ink tank connected for fluid communication to the negative pressure suction pump for recovering sucked waste ink.

Also, an ink jet printer disclosed in Patent Document 2 comprises a printing head having a plurality of nozzles, a cap having an opening in common to the plurality of nozzles of the printing head and a plurality of suction ports, the opening being brought into close contact with nozzle surfaces to form an enclosed space, at least one suction pump for sucking ink from the plurality of nozzles through the plurality of suction ports of the cap, and ink flow passages for connecting the suction ports of the cap to the suction pump, wherein the ink is jetted from the nozzles of the printing head to print dots on a medium, and the opening of the cap is brought into close contact with the nozzles to suck waste ink when power is turned on or when an occasion requires.

Further, Patent Document 3 discloses the following feature. By providing a plurality of suction ports in a suction cap and controlling the opening/closing operation of each of valves disposed in respective passages communicating with the suction ports, ink can be properly filled in all channels when the ink is initially introduced, and air bubbles can be efficiently removed from the channels near ends of a head in which the air bubbles tend to reside, when a periodic purge is performed.

Patent Document 1: Japanese Patent Laid-Open No. Hei 7-81089

Patent Document 2: Japanese Patent Laid-Open No. Hei 7-304191

Patent Document 3: Japanese Patent No. 3800855

DISCLOSURE OF THE INVENTION

Problems to be Solved by the Invention

When ink contains a solid component such as a pigment, there is a problem that fluidity of the ink itself is poor due to high viscosity and a fairly long time is required to fill the ink. Another problem is that expensive ink has to be wastefully consumed in a large amount for the purpose of maintenance.

In the case of the structure generating the negative pressure in the cap, if close contact between the head surface and the cap is not sufficient, a problem occurs in that ambient air is caused to enter the cap and a sufficient suction force cannot be obtained. Further, if the cap is removed after maintenance in a state where the interior of the cap is still under the negative pressure, the air pressure in the cap is abruptly changed and the ink filled in each nozzle of the head is oscillated corresponding to the abrupt pressure change. This raises still another problem that air is entrained through each nozzle with the oscillation of the ink and air bubbles are caused to enter the head again.

With the view of solving the above-described technical problems, an object of the present invention is to provide an ink jet ejection head and a liquid material application apparatus which are suitable for realizing maintenance of an ink jet head in such a manner as restoring ink ejection performance and ensuring satisfactory application free from an ejection failure in one or more nozzles.

Means for Solving the Problems

The inventor has previously invented a maintenance method of covering a nozzle of an ink jet head with a cap and generating a negative pressure in the cap to suck a liquid, the method comprising the steps of preparing a waste liquid tank communicating with both the cap and a negative pressure generation mechanism, a low-viscous liquid reservoir communicating with the ink jet head, an ink reservoir communicating with the ink jet head, and a liquid changing-over mechanism for alternately communicating the ink jet head with the low-viscous liquid reservoir or the ink reservoir, communicating the low-viscous liquid reservoir and the ink jet head with each other and generating the negative pressure in the cap to fill the low-viscous liquid in the ink jet head, and then communicating the ink reservoir and the ink jet head with each other to fill the ink in the ink jet head.

With the above-described construction of changing over the liquid supplied to the ink jet head by the liquid changing-over mechanism, however, there is a problem that the liquid having been supplied before the changing-over remains in a flow passage for communicating the liquid changing-over mechanism and the ink jet head with each other. On the other hand, it is required to perform maintenance of periodically or at desired timing.

Taking into account the above-described situation, the inventor has conceived a novel structure which can minimize the length of the flow passage for communicating the liquid changing-over mechanism and the ink jet head with each other without impairing maintainability of the ink jet head.

More specifically, a first aspect of the present invention resides in an ink jet ejection head of a liquid material application apparatus, comprising an ink jet head, a head holding member for holding the ink jet head in a detachable manner, and a changing-over mechanism connected to a liquid supply passage and a pressurized air supply passage, wherein the changing-over mechanism selectively supplies one of a liquid and pressurized air to the ink jet head.

According to a second aspect of the present invention, in the first aspect of the present invention, the changing-over mechanism includes a selector valve having a first flow passage communicating with the ink jet head, a second flow passage communicating with the liquid supply passage, and a third flow passage communicating with the pressurized air supply passage.

According to a third aspect of the present invention, in the first aspect of the present invention, the changing-over mechanism comprises a flow passage block having a first flow passage communicating with the ink jet head, a second flow passage communicating with the liquid supply passage, and a third flow passage communicating with the pressurized air supply passage, and a selector valve having a first position in which the first flow passage and the second flow passage in the flow passage block are communicated with each other, and a second position in which the first flow passage and the third flow passage in the flow passage block are communicated with each other.

According to a fourth aspect of the present invention, in the third aspect of the present invention, the selector valve is adjacently disposed above the flow passage block at a central position thereof, and a flexible tube communicating with the second flow passage and a flexible tube communicating with the third flow passage are arranged laterally of the selector valve disposed adjacent to the flow passage block.

According to a fifth aspect of the present invention, in the third or fourth aspect of the present invention, the flow passage block is separable into a plurality of small blocks.

A sixth aspect of the present invention resides in an ink jet ejection head of a liquid material application apparatus, comprising an ink jet head, a head holding member for holding the ink jet head in a detachable manner, and a changing-over mechanism connected to an ink supply passage, a cleaning liquid supply passage, and a pressurized air supply passage, wherein the changing-over mechanism selectively supplies one of ink, a cleaning liquid and pressurized air to the ink jet head.

According to a seventh aspect of the present invention, in the sixth aspect of the present invention, the changing-over mechanism includes a selector valve having a first flow passage communicating with the ink jet head, a second flow passage communicating with the ink supply passage, a third flow passage communicating with the cleaning liquid supply passage, and a fourth flow passage communicating with the pressurized air supply passage.

According to an eighth aspect of the present invention, in the sixth aspect of the present invention, the changing-over mechanism comprises a flow passage block having a first flow passage communicating with the ink jet head, a second flow passage communicating with the ink supply passage, a third flow passage communicating with the cleaning liquid supply passage, and a fourth flow passage communicating with the pressurized air supply passage; and a selector valve having a first position in which the first flow passage and the second flow passage in the flow passage block are communicated with each other, a second position in which the first flow passage and the third flow passage in the flow passage block are communicated with each other, and a third position in which the first flow passage and the fourth flow passage in the flow passage block are communicated with each other.

According to a ninth aspect of the present invention, in the eighth aspect of the present invention, the selector valve is adjacently disposed above the flow passage block at a central position thereof, and a flexible tube communicating with the second flow passage, a flexible tube communicating with the third flow passage, and a flexible tube communicating with the fourth flow passage are arranged laterally of the selector valve disposed adjacent to the flow passage block.

According to a tenth aspect of the present invention, in the eighth or ninth aspect of the present invention, the flow passage block is separable into a plurality of small blocks.

According to an eleventh aspect of the present invention, in any one of the first to tenth aspects of the present invention, the changing-over mechanism and the ink jet head are communicated with each other by one flexible tube.

A twelfth aspect of the present invention resides in a liquid material application apparatus including the ink jet ejection head according to any one of the first to eleventh aspects of the present invention.

Effect of the Invention

With the present invention, it is possible to reduce an amount of the ink wastefully consumed in maintenance, and to cut a time required for the maintenance.

DESCRIPTION OF REFERENCE CHARACTERS

Figure 1:
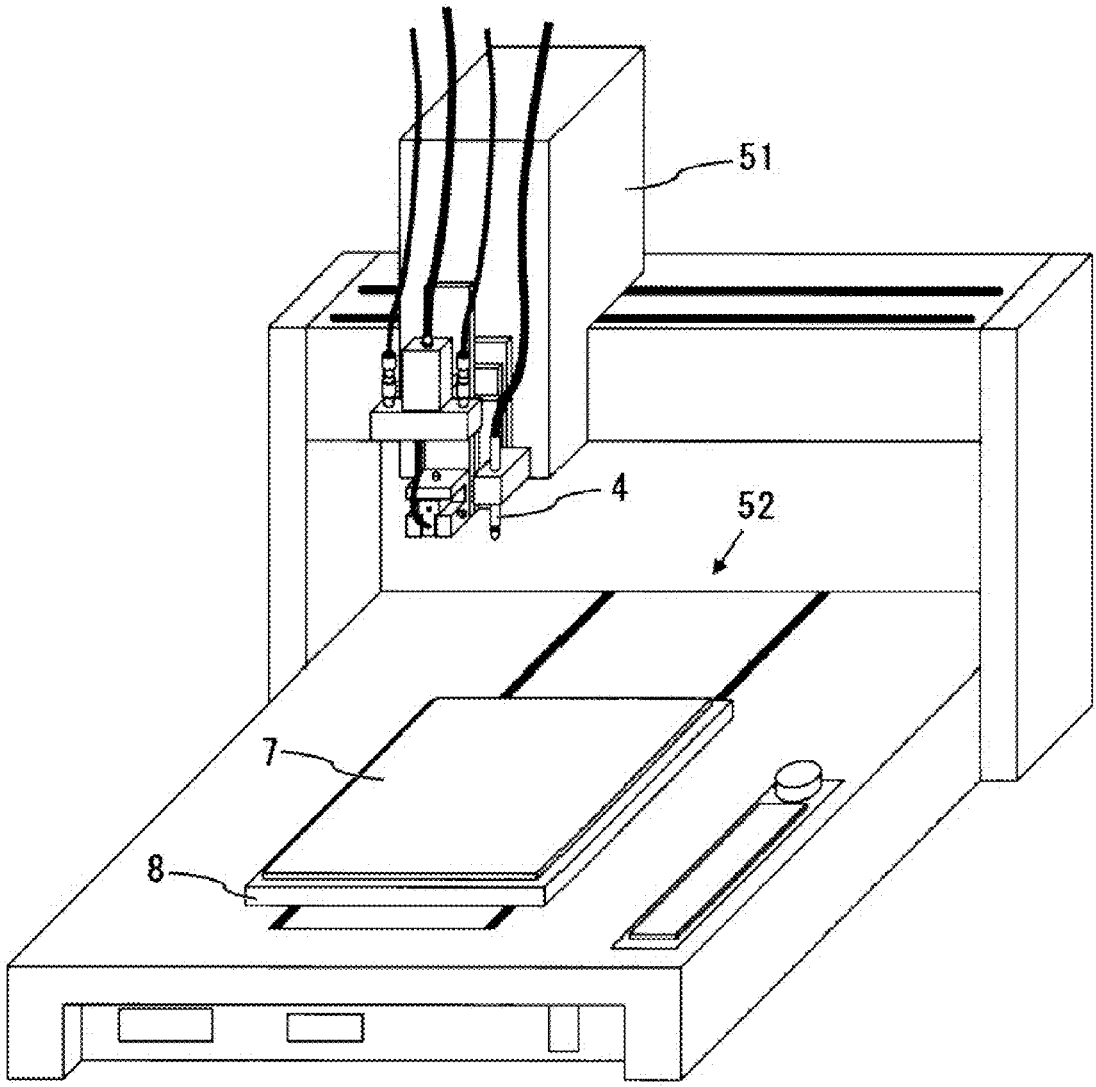
FIG. 1 is a perspective view of an application apparatus equipped with an ejection head according to Embodiment 1.

A legend of main reference characters used in the drawings is as follows:

1 ink jet head/2 head holding member/3 selector valve/4 contact sensor/5 base/6 flow passage block/7 workpiece/8 table/9 cap/10 nozzle/11 first supply tube/12 second supply tube/13 third supply tube/14 valve driving power line/15 head supply tube/16 signal line/21*a*-21*c* joints/23-26 fixing members (screws)/31 first flow passage/32 second flow passage/33 third flow passage/41 moving probe/51 X-direction moving mechanism/52 Y-direction moving mechanism/61 flow passage block support/91 abutment member/92 frame/93 support member/94 attachment member/95 through hole/96 joint

BEST MODE FOR CARRYING OUT THE INVENTION

While the present invention can be applied to various types of ink jet recording, the best mode for carrying out the present invention will be described below in connection with an ink jet printer, for example.

A maintenance mechanism of the present invention is intended to fill ink into an ink jet head when an ink cartridge is loaded or replaced, and to remove dust, dried ink, air bubbles, etc. in the ink jet head when a printing failure occurs. The ink jet head has a single or a plurality of nozzles which are each constituted by an extending cylinder, a hole bored in a plane surface, or the like.

The maintenance mechanism of the present invention comprises a liquid changing-over mechanism, a first tank for storing ink, and a second tank for storing a low-viscous liquid. With operation of the liquid changing-over mechanism, the ink and the low-viscous liquid can be selectively supplied to fill the liquid in the ink jet head for maintenance. Therefore, the ink can be filled after previously filling the low-viscous liquid having high fluidity and removing air bubbles before the ink is filled into the ink jet head. It is hence possible to reduce an amount of the ink wastefully consumed and to cut an ink filling time.

The liquid changing-over mechanism is preferably disposed near the ink jet head. With such an arrangement as allowing the ink and the low-viscous liquid to flow up to an inlet of the liquid changing-over mechanism, the amount of the ink wastefully consumed can be further reduced.

The changing-over mechanism is preferably constituted by a selector valve and a flow passage block. The flow passage block has a first flow passage for communicating the selector valve and the ink jet head with each other, a second flow passage for communicating a liquid supply passage and the selector valve with each other, and a third flow passage for communicating a pressurized air supply passage and the selector valve with each other, and the selector valve has a first position in which the first flow passage and the second flow passage are communicated with each other, and a second position in which the first flow passage and the third flow passage are communicated with each other.

As another preferred construction disclosed herein, the changing-over mechanism includes the selector valve having a first flow passage communicating with the ink jet head, a second flow passage communicating with the liquid supply passage, and a third flow passage communicating with the pressurized air supply passage.

Any type of liquid, such as ink and a cleaning liquid, can be sent to the "liquid supply passage".

In any construction, it is important to minimize the length of a flow passage for communicating the changing-over mechanism and the ink jet head with each other. The changing-over mechanism may be disposed above or laterally of the ink jet head.

The changing-over mechanism and the ink jet head are preferably communicated with each other by a flexible tube from the viewpoints of increasing the degree of freedom in arrangement of the changing-over mechanism and facilitating attachment and detachment of the ink jet head.

Further, with the construction capable of supplying the pressurized air to the ink jet head, an operation of detaching the ink jet head can be performed after draining the ink that remains in the ink jet head.

While a liquid having low viscosity and/or high fluidity can be used as the low-viscous liquid, the low-viscous liquid preferably has the function as a cleaning liquid. A practical example of the low-viscous liquid is a liquid made of only a solvent that is prepared by removing solid components in the ink used, or a solvent dissolving the ink.

Generally, ink for use in an ink jet printer is classified into dye-based ink and pigment-based ink. The term "dye" means a colorant that is dispersed into or solvated with a carrier medium in a molecular state. The carrier medium is a liquid or a solid at a room temperature. A commonly used example of the carrier medium is water or a mixture of water and an organic cosolvent. In general, the carrier medium contains water as a main component and additionally contains a colorant and a humectant (wet material), such as glycerin, for the purpose of preventing clogging, etc. When water is used as the carrier medium, ink employing that type of carrier medium is usually disadvantageous in having poor water-resistant toughness.

The term "pigment" means a colorant that is not dissolved in the carrier medium, but is dispersed or suspended therein in the form of small particles, and that is often stabilized by using a dispersant so as to prevent coagulation or sedimentation. Many compounds are known as being usable as pigments. One example of pigment ink contains a colorant that is prepared by forming microparticles of a pigment, e.g., an organic pigment or carbon black, with a surfactant and/or a dispersant, and by dispersing the microparticles in a medium, e.g., water.

The maintenance mechanism of the present invention can be applied regardless of whether the used ink is of the dye-based type or the pigment-based type. The viscosity of the ink is mainly at a level as low as about several tens cps. However, the maintenance mechanism of the present invention is also applicable to ink having viscosity equal to or higher than a medium level of about several hundreds cps so long as the ink is able to fly properly when ejected.

In addition, the present invention can be further applied to functional ink for use in printing of a wiring pattern on a printed board, coating of a lubricant onto a small part, printing of an outdoor light-resistant display material, printing of UV-curable ink, and so on.

The maintenance of the ink jet head according to the present invention is preformed by covering a nozzle of the ink jet head with a cap and generating a negative pressure in the cap to suck a liquid. More specifically, the maintenance comprises the steps of preparing a waste liquid tank communicating with both the cap and a negative pressure generation means, a low-viscous liquid reservoir communicating with the ink jet head, an ink reservoir communicating with the ink jet head, and liquid changing-over means for alternately communicating the ink jet head with the low-viscous liquid reservoir or the ink reservoir, communicating the low-viscous liquid reservoir and the ink jet head with each other and generating the negative pressure in the cap to fill the low-viscous liquid in the ink jet head, and then communicating the ink reservoir and the ink jet head with each other to fill the ink in the ink jet head.

Details of the present invention will be described below in connection with embodiments, but the present invention is in no way restricted by the following embodiments.

Embodiment 1

As shown in FIG. 1, an ejection head of Embodiment 1 is mounted to a liquid material application apparatus for applying a liquid material while the ejection head and a workpiece 7 are moved relative to each other. The ejection head is movable in the Z-direction and an amount of displacement of the ejection head can be measured by using a moving probe 41 of a contact sensor 4 so as to adjust a clearance between an ejection surface of an ink jet head 1 and the workpiece 7.

The ink jet head 1, which is known in itself and is mounted the ejection head, has a plurality of nozzle 10 and ejects ink stored in a first tank (not shown) for printing, etc. Maintenance of the ink jet head 1 is performed by covering the nozzles 10 with a cap 9, generating a negative pressure in the cap 9, and draining the sucked ink, etc. into a waste liquid tank.

Figure 12:
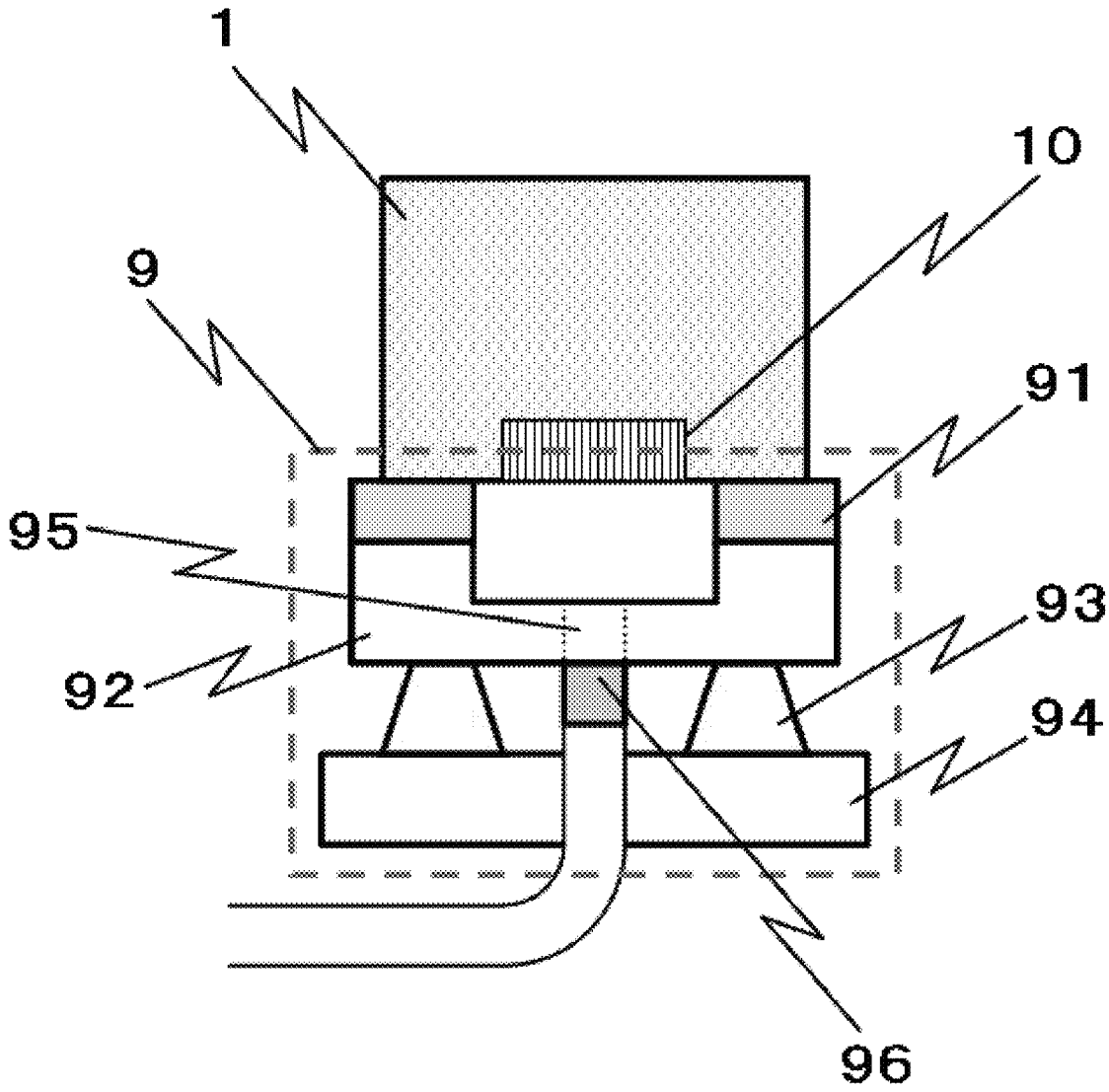
FIG. 12 is a schematic view, partly broken away, of a cap according to Embodiment 1.

As shown in FIG. 12, the cap 9 in this embodiment is constituted such that the cap 9 can have flexibility enough to follow an inclination of the head surface.

An abutment member 91 abutting against the head surface is made of a hard elastic member, i.e., rubber having a Shore A hardness of 40-80 (preferably 50-70) (in conformity with the standard of JIS K6253). The abutment member 91 is attached to an upper surface of a frame 92 by, e.g., bonding or screwing.

The frame 92 is supported by one or more support members 93 which are each made of a soft elastic member (e.g., rubber or spring) fixed in place by, e.g., bonding or screwing. The support member 93 preferably has a penetration index of 40-80 (preferably 50-70 degrees) in order that the cap can follow or accommodate a mounting error (three-dimensional inclination) of the nozzle surface of the ink jet head 1. The support member 93 is fixed to a plate-like attachment member 94. A joint, denoted by 96, capable of connecting at least one through hole 95 and a communicating member to each other is disposed at a bottom surface of the frame 92.

With the thus-constructed cap 9 in this embodiment, close contact and sealing performance can be ensured at a perfect level without being affected by the inclination of the nozzle surface.

Figure 2:
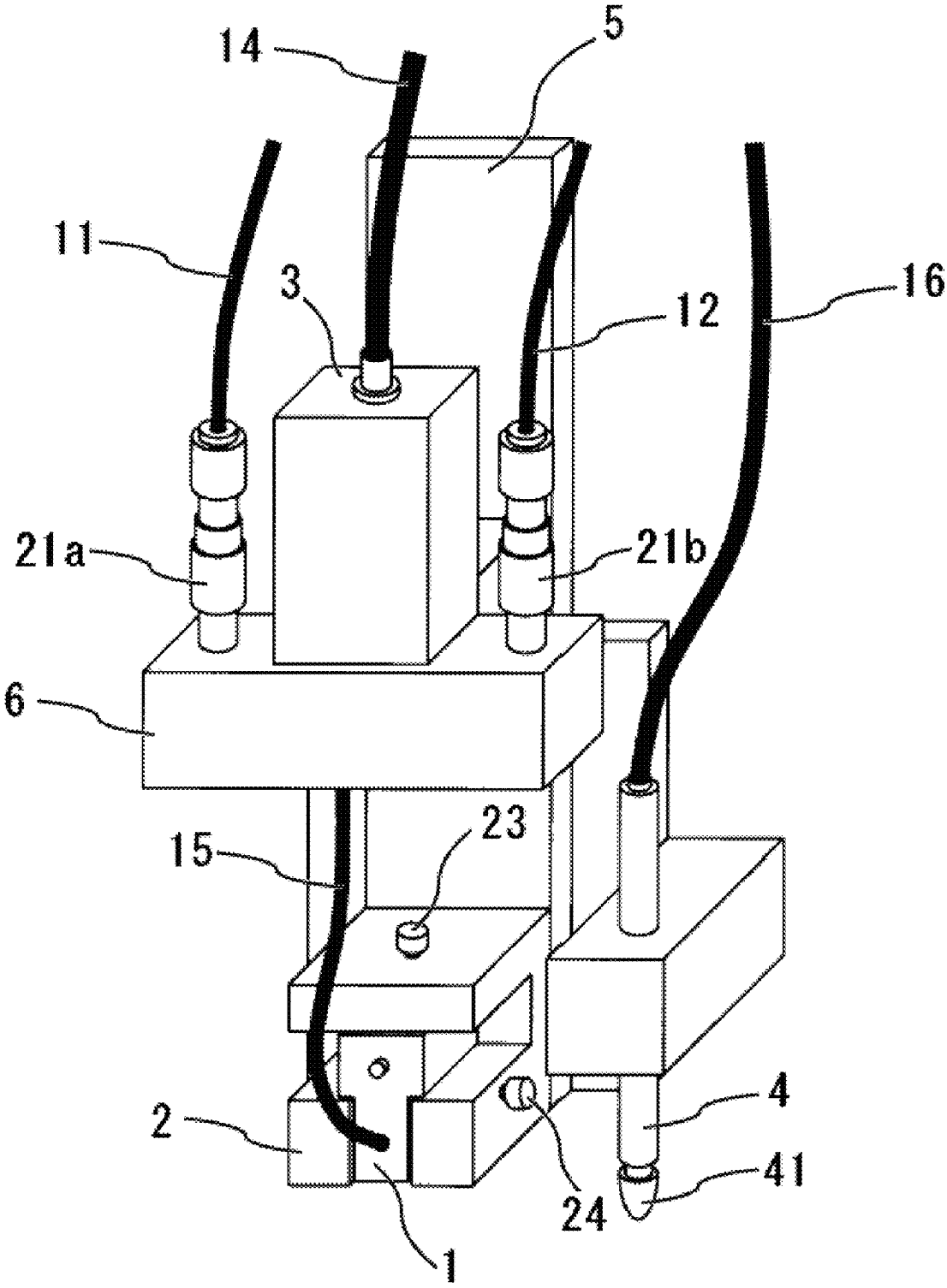
FIG. 2 is a perspective view of the ejection head according to Embodiment 1.
Figure 3:
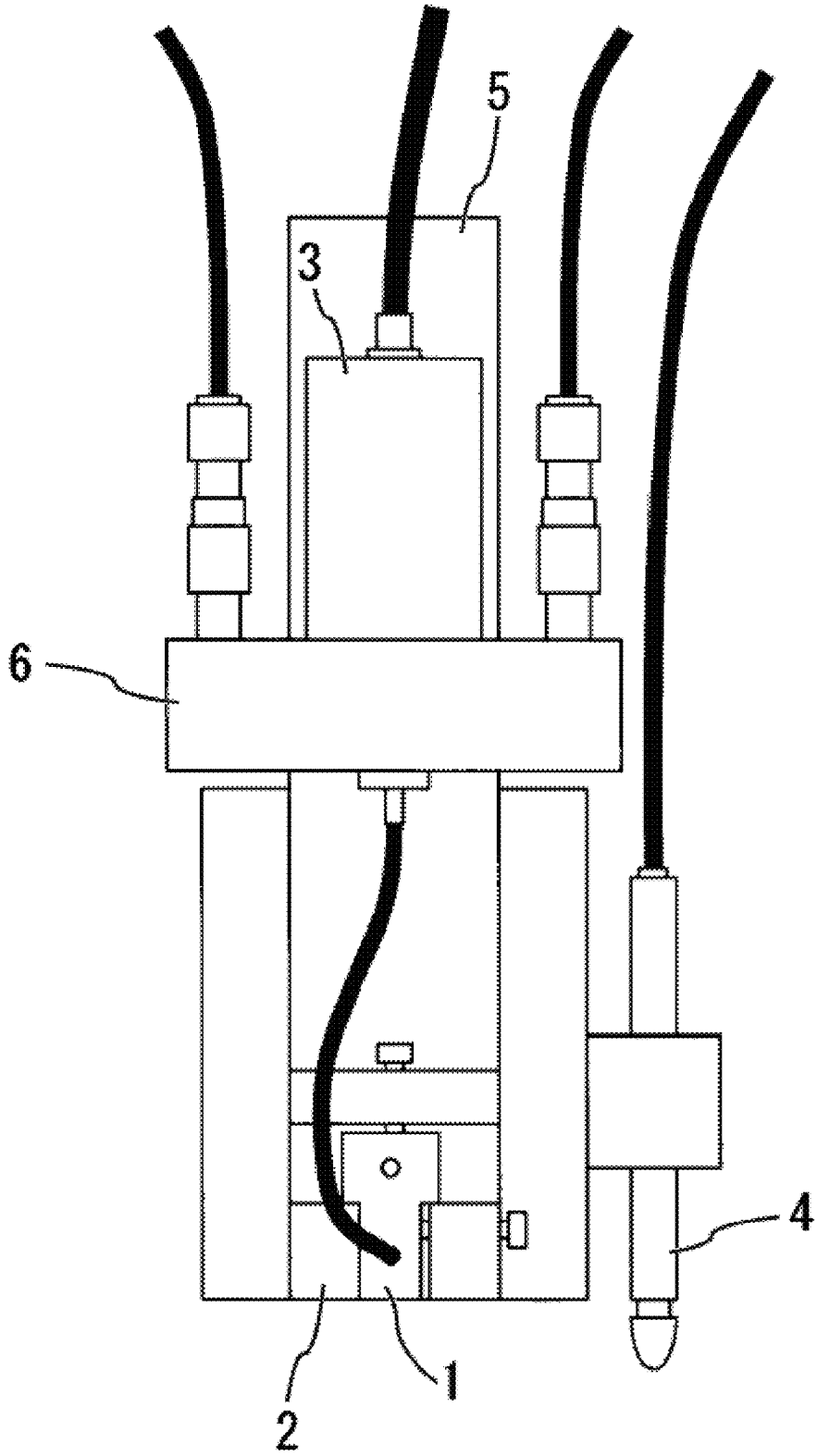
FIG. 3 is a front view of the ejection head according to Embodiment 1.
Figure 4:
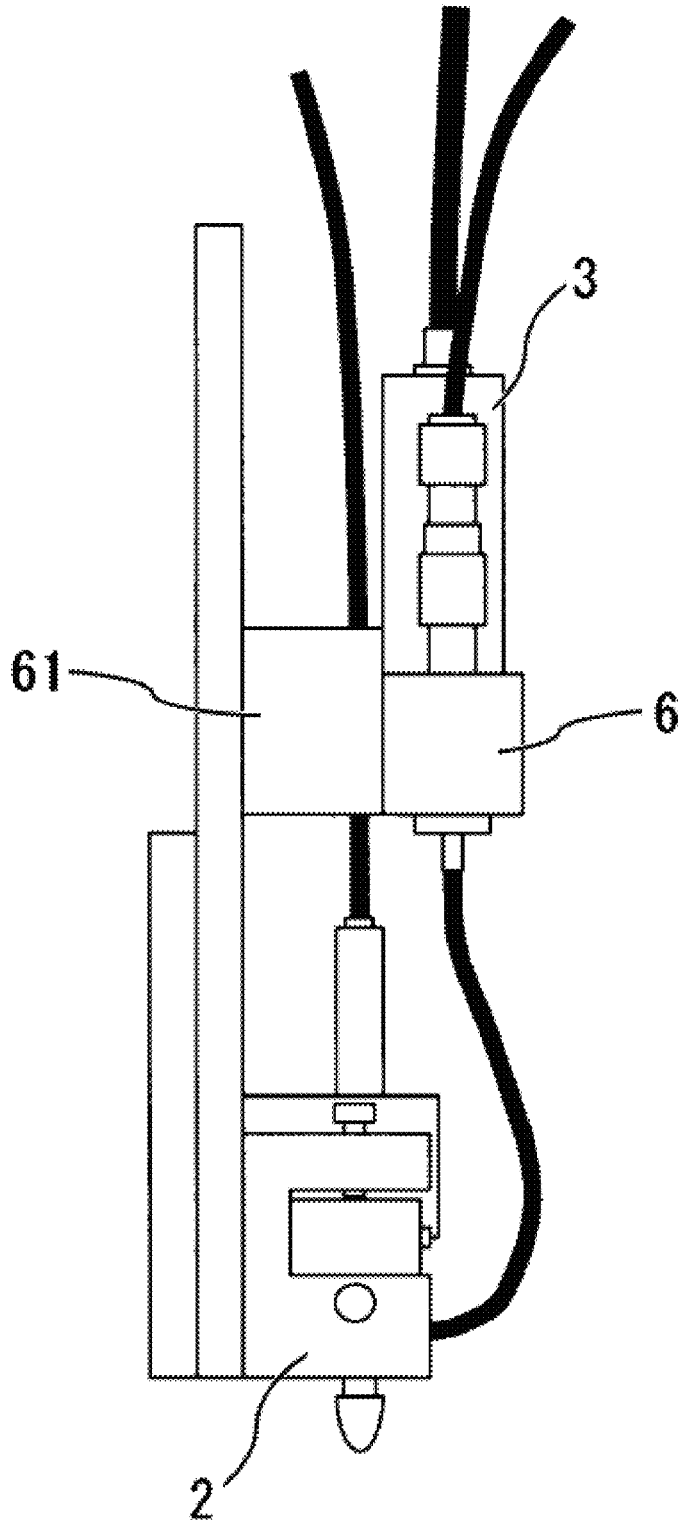
FIG. 4 is a side view of the ejection head according to Embodiment 1.

FIG. 2 is a perspective view of the ejection head according to Embodiment 1.

In FIG. 2, reference character 11 denotes a first supply tube, 12 denotes a second supply tube, 14 denotes a valve driving power line, and 15 denotes a head supply tube. Those tubes are each made of a flexible material.

By shifting a valve (not shown), a liquid material, e.g., ink, or a cleaning liquid is supplied through the first supply tube 11. Pressurized air is supplied through the second supply tube. Alternatively, the liquid material or the pressurized air may be supplied through the first supply tube 11, and the cleaning liquid or the pressurized air may be supplied through the second supply tube.

The ejection head of this embodiment is featured in having a selector valve 3 that is movable in the XYZ-directions together with the ink jet head 1. Because the ejection head has a structure that the ink jet head 1 and the selector valve 3 are constituted as an integral unit, the length of a flow passage (i.e., the length of the head supply tube 15) for communicating the ink jet head 1 and the selector valve 3 with each other can be minimized. However, because the head supply tube 15 is a consumable component, the distance between the ink jet head 1 and a flow passage block 6 is preferably set to such a distance as not impairing easiness of maintenance work.

Figure 5:
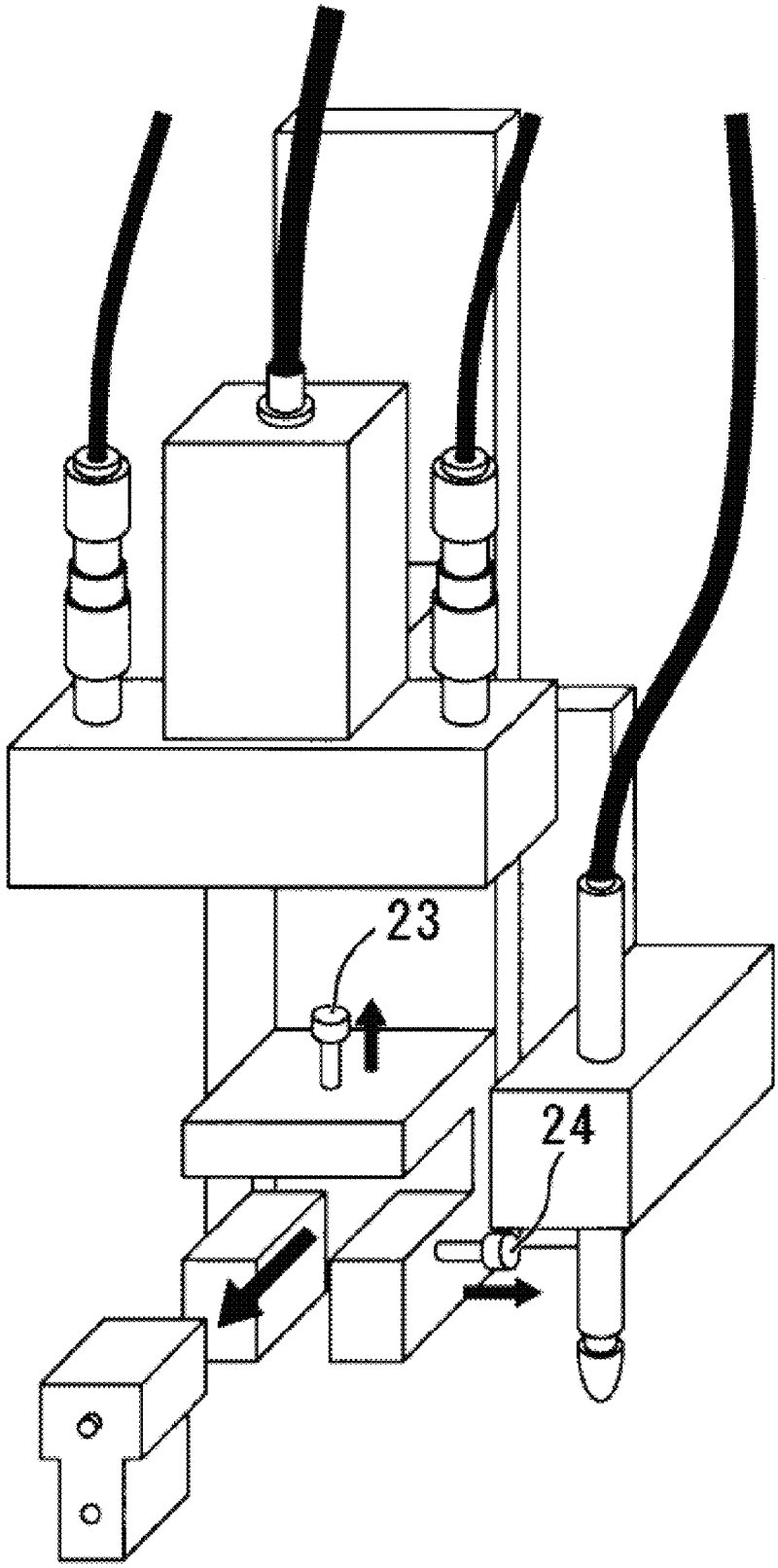
FIG. 5 is a perspective view for explaining a state where an ink jet head is removed from the ejection head according to Embodiment 1.

While this embodiment has a structure of including the selector valve 3 in the ejection head, maintainability of the ink jet head 1 is not impaired. More specifically, as shown in FIG. 5, the ink jet head 1 is detachably attached to a head holding member 2 by loosening screws 23 and 24. Further, the tubes each made of a flexible material are connected to the flow passage block and can be easily attached and detached, thus providing a structure ensuring easy maintenance.

It is needless to say that fixing members to be disposed are not limited to the screws 23 and 24 used in this embodiment. For example, in order to reduce the distance between the flow passage block 6 and the ink jet head 1, the screw 23 may be omitted and the fixing members may be disposed only at a side and/or under the ink jet head 1.

Figure 6:
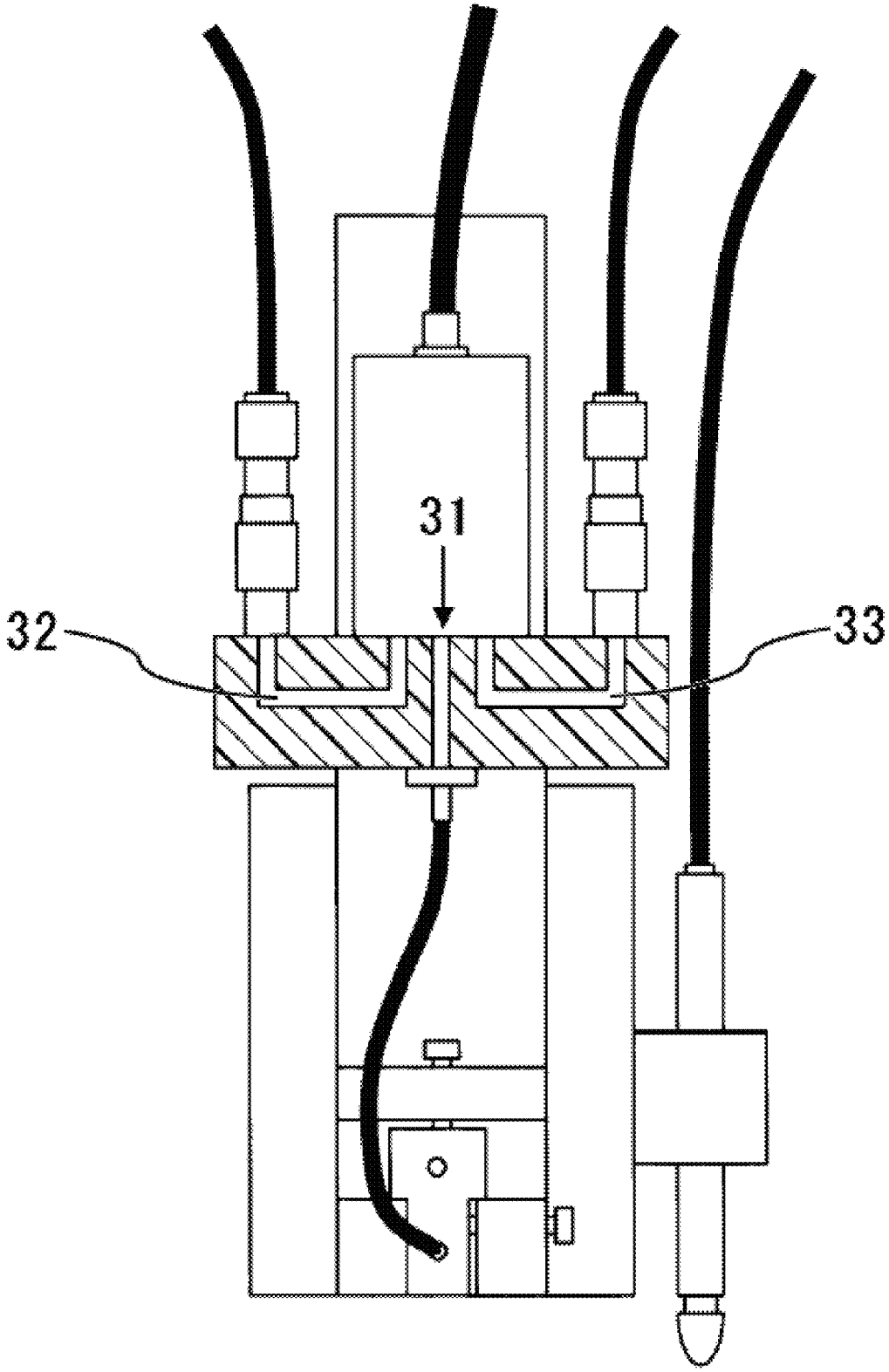
FIG. 6 is a front view, partly broken away, of the ejection head according to Embodiment 1.

In the flow passage block 6, as shown in FIG. 6, there are formed a first flow passage 31 for communicating the selector valve 3 and the ink jet head 1 with each other, a second flow passage 32 for communicating the first supply tube 11 and the selector valve 3 with each other, and a third flow passage 33 for communicating the second supply tube 12 and the selector valve 3 with each other.

The selector valve 3 has a first position in which the first flow passage 31 is communicated with the second flow passage 32 and it is cut off from the third flow passage 33, and a second position in which the first flow passage 31 is cut off from the second flow passage 32 and it is communicated with the third flow passage 33.

Figure 7:
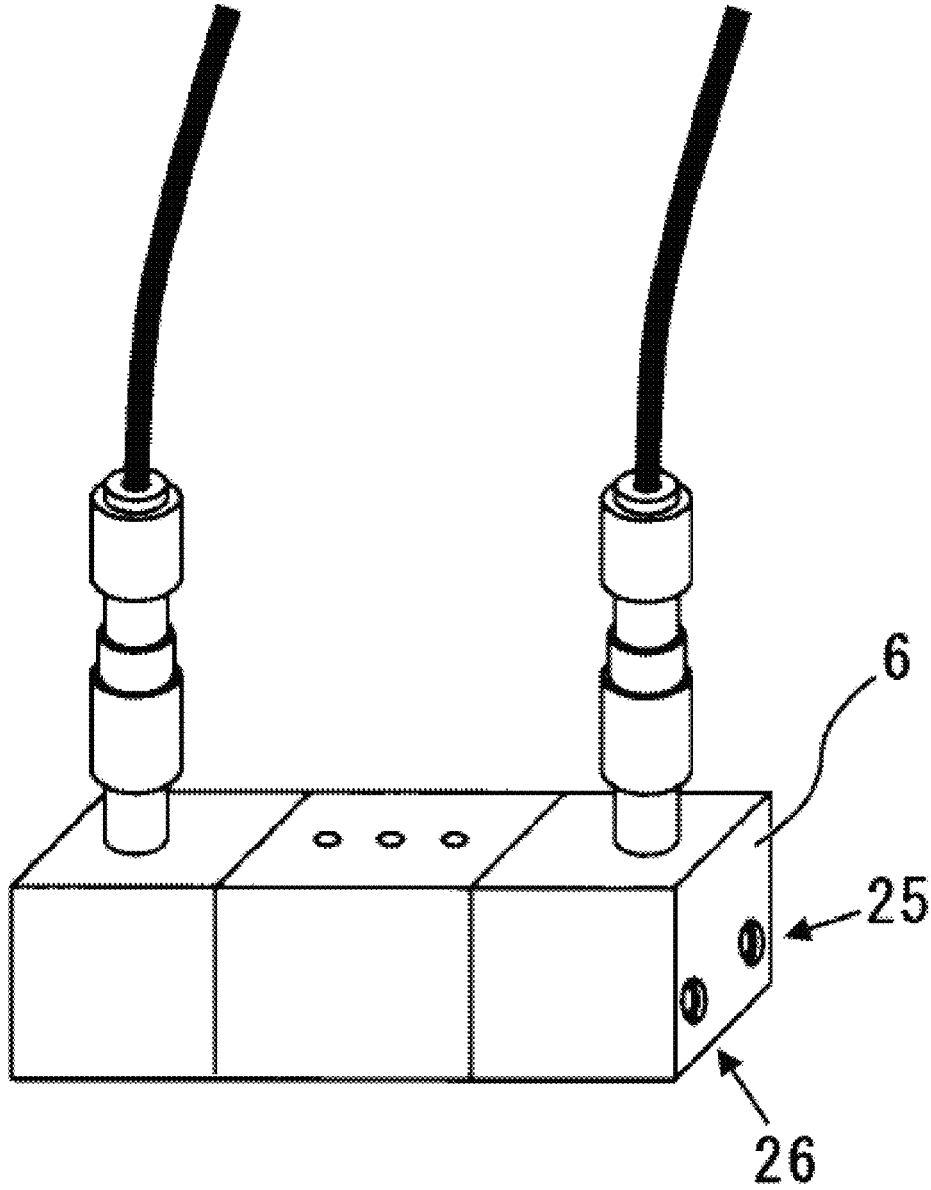
FIG. 7 is an enlarged perspective view of a flow passage block according to Embodiment 1.
Figure 8:
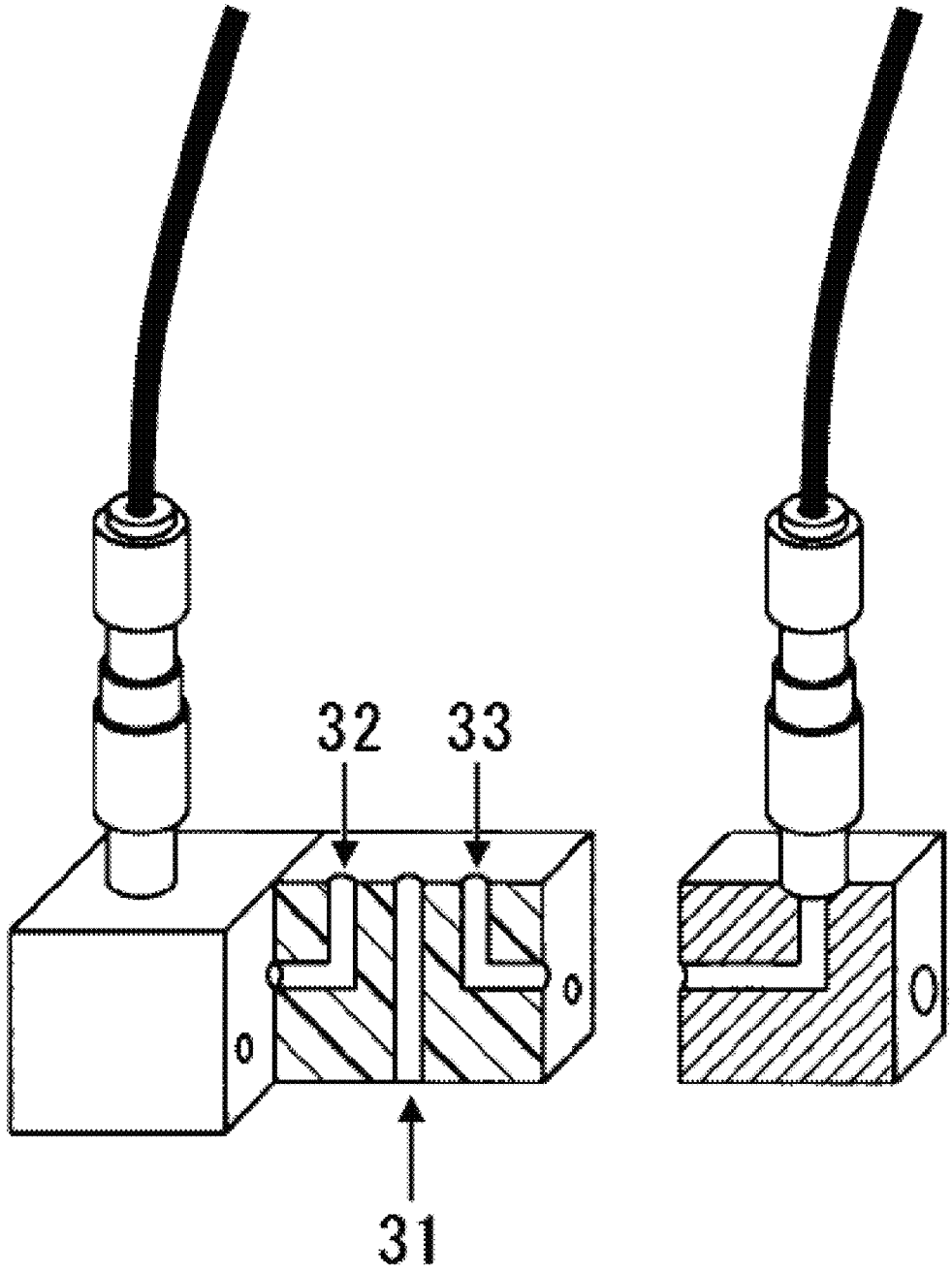
FIG. 8 is an enlarged perspective view, partly broken away, of the flow passage block according to Embodiment 1.

As shown in FIGS. 7 and 8, the flow passage block 6 can be separated into three parts by loosening a pair of right and left screws 25 and a pair of right and left screws 26. Further, since the tubes each made of a flexible material are connected through respective joints, they can be easily attached and detached, whereby a structure ensuring easy maintenance is obtained.

When a hard tube made of Teflon (registered trademark) is used as the flexible tube having chemical resistance, the structure employing the flow passage block in this embodiment is suitable because the structure allows the tube to be connected without bending it.

Embodiment 2

Figure 9:
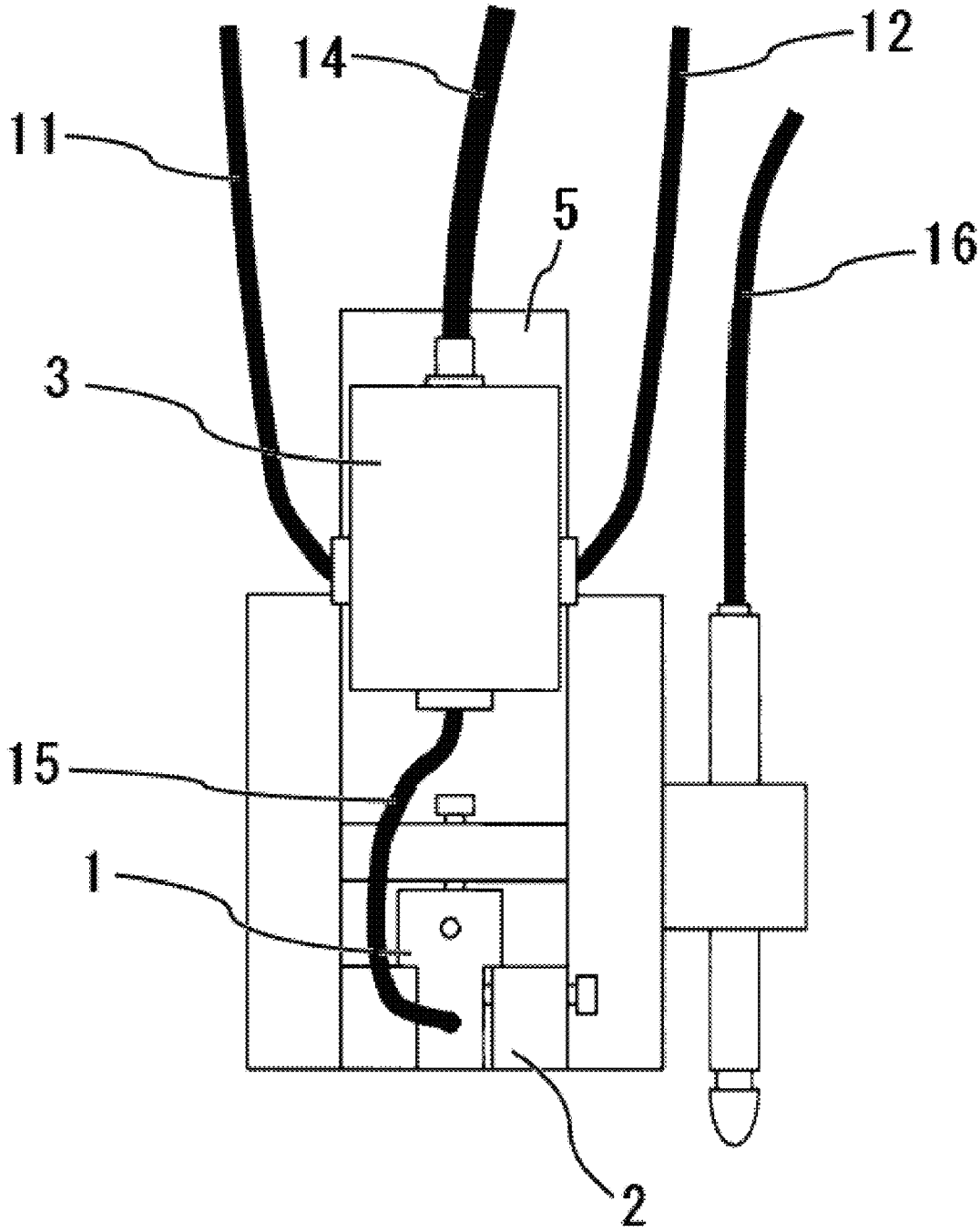
FIG. 9 is a front view of an ejection head according to Embodiment 2.
Figure 10:
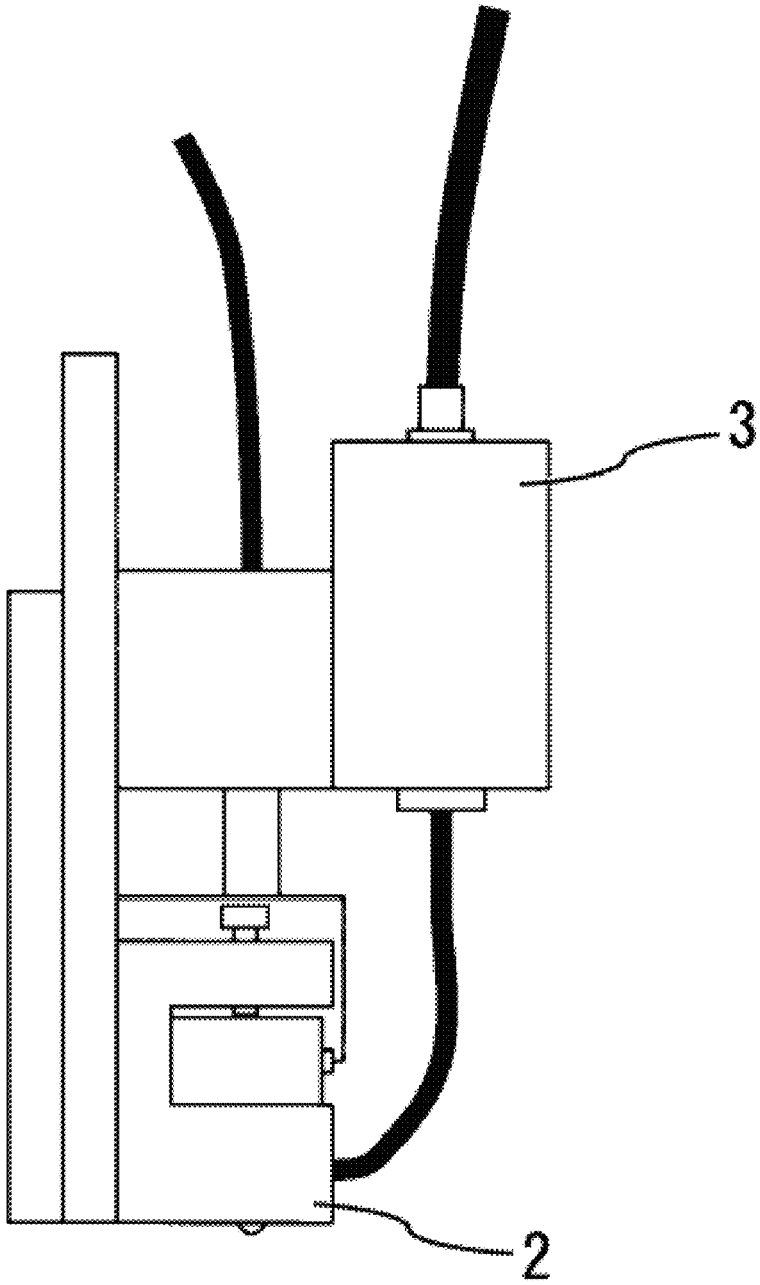
FIG. 10 is a side view of the ejection head according to Embodiment 2.

In an ejection head of Embodiment 2, as shown in FIGS. 9 and 10, tubes (flexible tubes) are directly connected to the selector valve 3. The ejection head of Embodiment 2 has a similar construction as that of Embodiment 1 except for the structure of the selector valve 3 and the absence of the flow passage block 6.

Since the ejection head of this embodiment does not include the flow passage block 6, a flow passage for communicating the selector valve 3 and the ink jet head 1 with each other has a shorter length than that in Embodiment 1. Further, since the number of components is reduced, superior cost efficiency and maintainability can be obtained.

Embodiment 3

Figure 11:
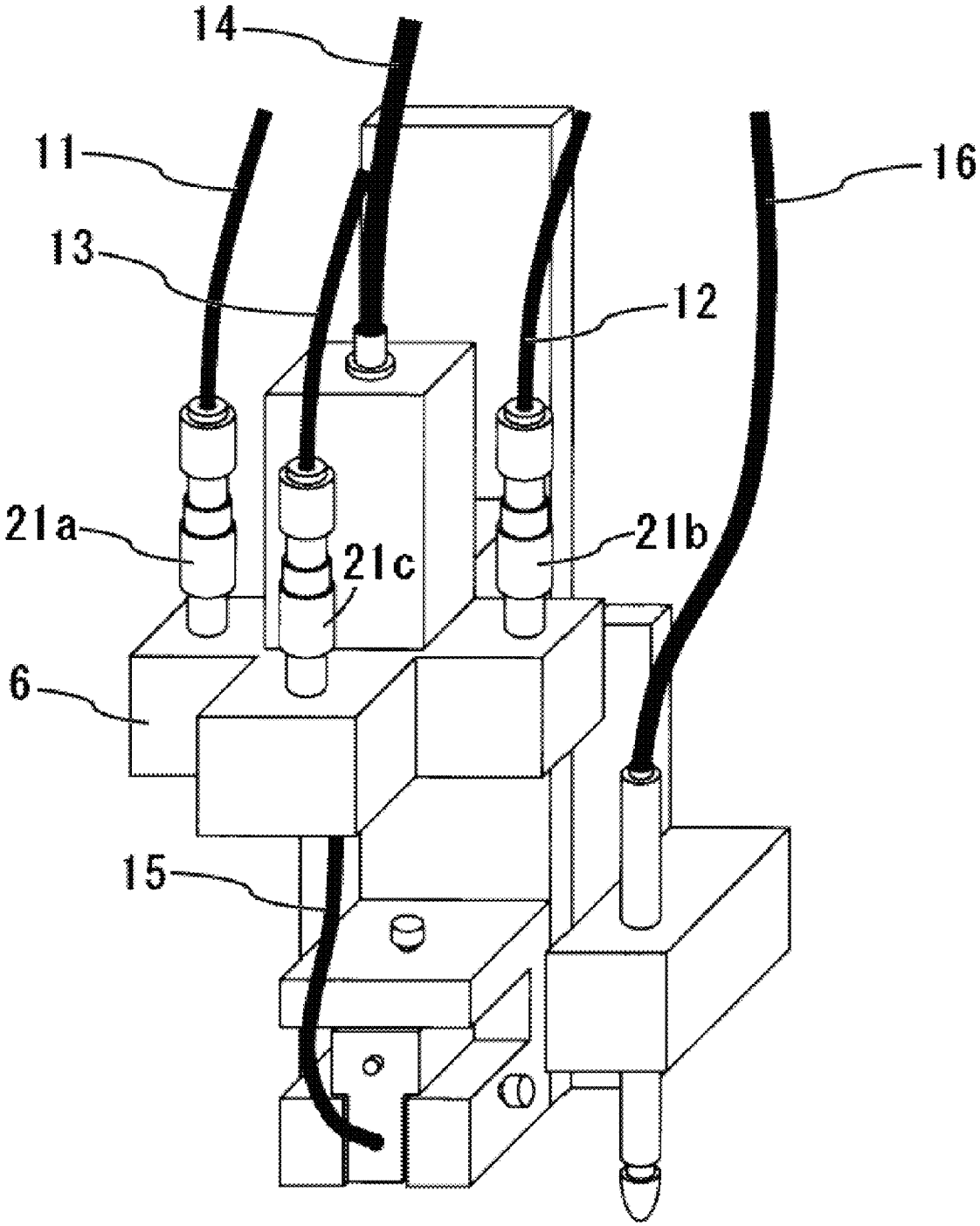
FIG. 11 is a perspective view of an ejection head according to Embodiment 3.

In an ejection head of Embodiment 3, as shown in FIG. 11, the number of joints disposed on the flow passage block 6 is increased.

The selector valve 3 has a first position in which the first supply tube 11 is communicated with the head supply tube 15 and it is cut off from communication with others, a second position in which the second supply tube 12 is communicated with the head supply tube 15 and it is cut off from communication with others, and a third position in which a third supply tube 13 is communicated with the head supply tube 15 and it is cut off from others.

While the selector valve 3 is constituted as a three-way valve in this embodiment, the number of supply tubes to be connected can be changed, as required, depending on the use in practice. In other words, plural kinds of liquid materials can be selectively changed over by constituting the selector valve 3 as one selected from among a four-way valve, a five-way valve, etc.

INDUSTRIAL APPLICABILITY

The usable field of the present invention is not limited to an ink jet printer, and the present invention can also be applied to various types of ink jet recording which are used in a precision spray/injection apparatus (including a coating apparatus), a precision application apparatus, etc. Further, the present invention can be applied to an application apparatus, a drawing apparatus and a printing apparatus, which are used for ink jet patterning in processes for printing of an organic EL display panel and a large-sized color panel, industrial marking, etc.

Also, the ink jet recording method usable in the present invention is not limited to a particular one and may include, for example, the mechanical conversion type such as the piezoelectric type, and the bubble generating type such as the resistance heat-generating jet type.

In addition, the present invention can be further utilized in a lens coloring step in the lens industry, as well as in drawing of posters and decorations on construction materials in the large-sized printing industry.

The invention claimed is:

1. An ink jet ejection head of a liquid material application apparatus, comprising:

an ink jet head, a head holding member to hold the ink jet head in a detachable manner, a changing-over mechanism connected to a liquid supply passage and a pressurized air supply passage, and a base member on which the holding member and the changing-over mechanism are disposed, wherein the changing-over mechanism is disposed near the holding member, and the changing-over mechanism and the ink jet head are communicated with each other through a first flexible tube.

2. The ink jet ejection head according to claim 1, wherein the changing-over mechanism includes a selector valve having a first flow passage communicating with the ink jet head, a second flow passage communicating with the liquid supply passage, and a third flow passage communicating with the pressurized air supply passage.

3. The ink jet ejection head according to claim 1, wherein the changing-over mechanism comprises a flow passage block having a first flow passage communicating with the ink jet head, a second flow passage communicating with the liquid supply passage, and a third flow passage communicating with the pressurized air supply passage, and a selector valve having a first position in which the first flow passage and the second flow passage in the flow passage block are communicated with each other, and a second position in which the first flow passage and the third flow passage in the flow passage block are communicated with each other.

4. The ink jet ejection head according to claim 3, wherein the selector valve is adjacently disposed above the flow passage block at a central position thereof, and wherein a second flexible tube communicating with the second flow passage and a third flexible tube communicating with the third flow passage are arranged laterally of the selector valve disposed adjacent to the flow passage block.

5. The ink jet ejection head according to claim 3 or 4, wherein the flow passage block is separable into a plurality of small blocks.

6. The ink jet ejection head according to claim 1, 2, 3 or 4, wherein the holding member includes an opening to which the ink jet head is mounted, a support portion for supporting the ink jet head mounted to the opening, and a fixing member for fixing the ink jet head mounted to the opening.

7. A liquid material application apparatus including the ink jet ejection head according to any one of claim 1, 2, 3 or 4.

8. An ink jet ejection head of a liquid material application apparatus, comprising an ink jet head, a head holding member to hold the ink jet head in a detachable manner, a changing-over mechanism connected to a liquid material supply passage, a cleaning liquid supply passage, and a pressurized air supply passage, and a base member on which the holding member and the changing-over mechanism are disposed, wherein the changing-over mechanism is disposed near the holding member, and the changing-over mechanism and the ink jet head are communicated with each other through a first flexible tube.

9. The ink jet ejection head according to claim 8, wherein the changing-over mechanism includes a selector valve having a first flow passage communicating with the ink jet head, a second flow passage communicating with the liquid material supply passage, a third flow passage communicating with the cleaning liquid supply passage, and a fourth flow passage communicating with the pressurized air supply passage.

10. The ink jet ejection head according to claim 8, wherein the changing-over mechanism comprises a flow passage block having a first flow passage communicating with the ink jet head, a second flow passage communicating with the liquid material supply passage, a third flow passage communicating with the cleaning liquid supply passage, and a fourth flow passage communicating with the pressurized air supply passage; and a selector valve having a first position in which the first flow passage and the second flow passage in the flow passage block are communicated with each other, a second position in which the first flow passage and the third flow passage in the flow passage block are communicated with each other, and a third position in which the first flow passage and the fourth flow passage in the flow passage block are communicated with each other.

11. The ink jet ejection head according to claim 10, wherein the selector valve is adjacently disposed above the flow passage block at a central position thereof, and wherein a second flexible tube communicating with the second flow passage, a third flexible tube communicating with the third flow passage, and a fourth flexible tube communicating with the fourth flow passage are arranged laterally of the selector valve disposed adjacent to the flow passage block.

12. The ink jet ejection head according to claim 10 or 11, wherein the flow passage block is separable into a plurality of small blocks.

13. The ink jet ejection head according to claim 8, 9, 10 or 11, wherein the holding member includes an opening to which the ink jet head is mounted, a support portion for supporting the ink jet head mounted to the opening, and a fixing member for fixing the ink jet head mounted to the opening.

14. A liquid material application apparatus including the ink jet ejection head according to claim 8, 9, 10 or 11.

15. An ink jet ejection head of a liquid material application apparatus, comprising an ink jet head, a head holding member to hold the ink jet head in a detachable manner, a changing-over mechanism connected to a liquid material supply passage, and a cleaning liquid supply passage, and a base member on which the holding member and the changing-over mechanism are disposed, wherein the changing-over mechanism is disposed near the holding member, and the changing-over mechanism and the ink jet head are communicated with each other through a first flexible tube.

16. The ink jet ejection head according to claim 15, wherein the changing-over mechanism includes a selector valve having a first flow passage communicating with the ink jet head, a second flow passage communicating with the liquid material supply passage, and a third flow passage communicating with the cleaning liquid supply passage.

17. The ink jet ejection head according to claim 15, wherein the changing-over mechanism comprises a flow passage block having a first flow passage communicating with the ink jet head, a second flow passage communicating with the liquid material supply passage, and a third flow passage communicating with the cleaning liquid supply passage, and a selector valve having a first position in which the first flow passage and the second flow passage in the flow passage block are communicated with each other, and a second position in which the first flow passage and the third flow passage in the flow passage block are communicated with each other.

18. The ink jet ejection head according to claim 17, wherein the selector valve is adjacently disposed above the flow passage block at a central position thereof, and wherein a second flexible tube communicating with the second flow passage and a third flexible tube communicating with the third flow passage are arranged laterally of the selector valve disposed adjacent to the flow passage block.

19. The ink jet ejection head according to claim 17 or 18, wherein the flow passage block is separable into a plurality of small blocks.

20. The ink jet ejection head according to claim 15, 16, 17 or 18, wherein the holding member includes an opening to which the ink jet head is mounted, a support portion for supporting the ink jet head mounted to the opening, and a fixing member for fixing the ink jet head mounted to the opening.

21. A liquid material application apparatus including the ink jet ejection head according to claim 15, 16, 17 or 18.

22. The ink jet ejection head according to claim 1, 8 or 15, wherein the ink jet head has a plurality of nozzle.

23. The ink jet ejection head according to claim 1, 8 or 15, wherein the changing-over mechanism is disposed near the ink jet head such that the length of the first flexible tube is minimized and a distance between the ink jet head and the changing-over mechanism is set to such a distance as not impairing easiness of maintenance work.

* * * * *